United States Patent [19]

Winheim

[11] Patent Number: 4,915,788

[45] Date of Patent: Apr. 10, 1990

[54] METHOD OF CONTACTING RUNNING WEBS WITH STEAM

[75] Inventor: Stefan H. Winheim, Frankfurt am Main, Fed. Rep. of Germany

[73] Assignee: V.I.B. Apparatebau GmbH, Maintal, Fed. Rep. of Germany

[21] Appl. No.: 302,075

[22] Filed: Jan. 24, 1989

Related U.S. Application Data

[63] Continuation of Ser. No. 82,786, Aug. 6, 1987, abandoned.

[30] Foreign Application Priority Data

Jan. 20, 1987 [DE] Fed. Rep. of Germany ..... 3701406

[51] Int. Cl.[4] ..... D21F 5/00

[52] U.S. Cl. ..... 162/207; 162/290; 34/16; 34/23; 34/155; 34/160

[58] Field of Search ..... 162/207, 290, 275; 34/155, 160, 26, 23; 226/97; 239/290, 428 S

[56] References Cited

U.S. PATENT DOCUMENTS 3,549,070 12/1970 Frost et al. ..... 226/97
4,351,700 9/1982 Dove ..... 162/252
4,384,666 5/1983 Koponen et al. ..... 226/97
4,414,757 11/1983 Whipple ..... 34/156
4,444,622 4/1984 Dove ..... 162/207
4,685,221 8/1987 Taylor et al. ..... 162/207

*Primary Examiner*—Karen M. Hastings
*Attorney, Agent, or Firm*—Peter K. Kontler

[57] ABSTRACT

Steam is blown against one side of a running web of moist fibrous material in a paper making machine through a first set of apertures in the wall of an apparatus which defines a first chamber for supplying steam to the first set of apertures, a second chamber which supplies steam to a second set of apertures upstream of the first set, and a third chamber which supplies steam to a third set of apretures downstream of the first set. The apertures of the first set discharge jets of steam at right angles to the plane of the adjacent portion of the running web, the apertures of the second set discharge jets of steam which draws some atmospheric air toward the jets issuing from the first set of apertures, and the jets of steam issuing from the third set of apertures also draw air toward the region where the jets issuing from the first set of apertures impinge upon the web so that steam is less likely to escape from the treating zone and that each increment of the running web is contacted by a preselected quantity of steam.

18 Claims, 6 Drawing Sheets

24
19
27
13
28
29
31
31
11
28
G
H
22
10
26
1
15
23

METHOD OF CONTACTING RUNNING WEBS WITH STEAM

This application is a continuation of application Ser. No. 082,786, filed Aug. 6, 1987, now abandoned.

BACKGROUND OF THE INVENTION

The invention relates to improvements in methods of and in apparatus for treating running webs with fluid media, especially for treating running webs of moist fibrous material with steam.

Steam distribution methods and apparatus which are used to promote the rate of drainage of water from sheets or webs of fibrous material in paper making machines are disclosed, for example, in U.S. Pats. Nos. 4,351,700 and 4,444,622 to Dove. Condensate which deposits on the running web as a result of contact between the web and steam raises the temperature of the web which, in turn, promotes drainage of water from the web ahead of the drying zone where the remaining water must be expelled by evaporation. Moreover, the rate at which longitudinally extending portions of the web are contacted with steam can be regulated to impart to the web a preselected moisture profile ahead of the drying station.

The housing of the patented steam distribution apparatus can be disposed above or below the path of the running web or adjacent a convex side of such path, depending upon the selected location of the apparatus in a paper making machine. Thus, if the distribution apparatus is placed next to the nip of a Yankee cylinder with a suction press roll, its steam discharging wall has a concave side which faces the adjacent convex side of the running web of moist fibrous material. The housing of the distribution apparatus will be placed above the path of the web in a straight through press or in a Fourdrinier machine and beneath the path of the web in the suction transfer zone of a paper making machine. Regardless of the location of the apparatus, the latter is designed to develop a so-called steam curtain at its upstream end, and the purpose of the steam curtain is to prevent penetration of surrounding atmospheric air into the treating zone between the orifices of the housing of the distribution apparatus and the adjacent side of the running web. The steam curtain at the upstream side of the apparatus is formed by discharging steam at a higher pressure than the pressure of steam which is discharged between the upstream and downstream sides. The establishment of a steam curtain is deemed necessary because air is a non-condensable gas and, according to the patentee, the presence of air in the zone where the bulk of steam impinges upon the running web would reduce the rate of steam condensation by a factor of the order of 4 to 1. The outer side of the apertured wall at the trailing edge of the apparatus which is disclosed in U.S. Pat. No. 4,351,700 has a convex shape and the jets of steam which issue therefrom are directed forwardly, i.e., in the direction of advancement of the running web. In each of the aforementioned patents, the inventor emphasizes the need to prevent penetration of air into the region between the housing of the apparatus and the path for the running web.

OBJECTS AND SUMMARY OF THE INVENTION

An object of the invention is to provide a novel and improved method of contacting a running web of wet paper or the like with a fluid medium, particularly steam, in such a way that at least the major percentage of the fluid medium is prevented from leaving the treating zone.

Another object of the invention is to enhance the efficiency of steam distribution apparatus which are used in paper making machines ahead of the heating zones.

A further object of the invention is to provide a method which ensures that atmospheric air will be compelled to enter the treating zone, at least at the leading edge of the distribution apparatus.

An additional object of the invention is to provide a method which ensures that the area surrounding the treating zone is adequately sealed from fluid medium which is applied in the treating zone.

Still another object of the invention is to provide a method which renders it possible to prevent the escape of fluid medium from the treating zone regardless of the selected speed of advancement of the running web and the nature of the material of the web.

A further object of the invention is to provide a simple, compact and relatively inexpensive apparatus for the practice of the above outlined method and to design the apparatus in such a way that it can be used for the treatment of webs which are caused to advance along a horizontal or otherwise inclined path, as well as for the treatment of webs which are caused to advance along a straight or along an arcuate path, regardless of whether the apparatus is to be located above, below or at the level of the treating zone.

An additional object of the invention is to provide the apparatus with novel and improved means for orienting jets of fluid medium against a running web in such a way that the jets draw atmospheric air into the treating zone or zones.

A further object of the invention is to provide the apparatus with novel and improved means for supplying fluid medium to the devices which direct the medium against the running web.

Another object of the invention is to provide an apparatus which can be used in existing paper making machines as a superior substitute for existing apparatus.

An additional object of the invention is to provide the apparatus with novel and improved means for distributing the admitted fluid medium across the path of advancement of the running web.

A further object of the invention is to provide the apparatus with novel and improved flow restrictor means at the leading and trailing edges of the treating zone.

Another object of the invention is to provide the apparatus with novel and improved means for causing penetration of fluid media through the layers of condensate on running webs of paper and the like.

One feature of the invention resides in the provision of a method of treating a running web with a fluid medium, particularly of treating a web of moist fibrous material with steam to promote draining of moisture. The method comprises the steps of transporting or advancing the web along a predetermined path, a first directing step which includes directing at least one first stream of fluid medium against one side of the running web in a predetermined portion of the path, a second directing step which includes directing at least one additional stream of fluid medium against the one side of the running web in a second portion of the path adjacent the predetermined portion (upstream or downstream as seen in the direction of advancement of the web), and orienting the additional stream with reference to the web in the path in such a way that the additional stream draws atmospheric air toward the predetermined portion of the path, i.e., the orientation of the additional stream is such that atmospheric air tends to flow along the one side of the running web and toward the predetermined portion of the path due to the well-known venturi effect.

The first directing step preferably includes directing a plurality of first jets of fluid medium in a first direction (as a rule substantially at right angles to the one side of the running web), and the second directing step then comprises directing a plurality of second jets against the one side of the running web in the second portion of the path. The orienting step of such method comprises confining the jets which together form the additional stream to a flow at an acute angle to the first direction. The step of directing the first stream includes conveying the stream through at least one aperture having a length which at least equals the width thereof.

The method can further comprise the step of regulating the velocity of at least one of the first and additional streams so as to enable the drawn atmospheric air to prevent the fluid medium from flowing from the predetermined and second portions of the path along the one side of the running web and counter to the direction of flow of atmospheric air which is being drawn by the additional stream.

The method of the invention can be defined in a different way by stating that the orienting step includes inclining the additional stream with reference to the first stream in such a way that the fluid medium of the first stream is prevented from flowing along the one side of the running web and across the second portion of the path.

The method can further comprise the steps of regulating the quantity of fluid medium which forms at least one of the first and additional streams, for example, of regulating the quantity of fluid medium which forms the first stream in order to ensure adequate treatment of successive increments of the running web, and of regulating the quantity of fluid medium which forms the additional stream in order to ensure that the quantity of air which is drawn into the treating zone (predetermined and second portions of the path) is not excessive but that no appreciable quantities of fluid medium can escape from the treating zone across or from the second portion of the path. The regulating steps can include regulating the velocity of the fluid medium forming the respective stream or streams.

The method can also comprise the step of regulating the temperature of fluid medium which forms the first and/or the additional stream.

The first directing step can include establishing and maintaining a supply of fluid medium adjacent the predetermined portion of the path (e.g., in a plenum chamber or in a set of smaller plenum chambers forming a row which extends transversely of the direction of advancement of the running web), and discharging a plurality of discrete jets of fluid medium from the supply against the one side of the web in the predetermined portion of the path. Such method can further comprise the step of continuously admitting fresh fluid medium to the supply, including directing into the supply a plurality of streamlets of fluid medium at an acute angle to the one side of the running web in the predetermined portion of the path so that the streamlets form at least one annulus of streamlets, preferably at least one annulus of streamlets in each of the aforementioned smaller plenum chambers.

The second portion of the path can be located upstream or downstream of the predetermined portion, as seen in the direction of advancement of the web. The one side of the web can be the upper side or the underside of the web. Alternatively, and if the web is advanced along an arcuate path (e.g., along a path which is defined by the periphery of a rotating cylinder or a like conveyor), the one side of the web is the convex side of such web.

Another feature of the invention resides in the provision of an apparatus for contacting a fluid medium with a running web which is advanced along a predetermined path, particularly for contacting a web of moist fibrous material with steam. The apparatus comprises first directing means for directing at least one first stream of fluid medium against one side of the running web in a predetermined portion of the path, and second directing means for directing at least one additional stream of fluid medium against the one side of the running web in a second portion of the path adjacent the predetermined portion and in such orientation that the additional stream draws atmospheric air along the one side of the running web and toward the predetermined portion of the path, i.e., that the additional stream produces a venturi effect which prevents the fluid medium of the first stream from flowing along one the side of the running web and across the second portion of the path.

The apparatus further comprises a housing for a supply of pressurized fluid medium. The housing has an apertured wall which is adjacent the path of the running web and the wall includes a first apertured portion forming part of or constituting the first directing means and a second apertured portion forming part of or constituting the second directing means. The first portion of the apertured wall has apertures which direct fluid medium against the running web in a first direction (preferably substantially at right angles to the plane of the web in the predetermined portion of the path), and the second portion of the wall has apertures which direct fluid medium against the one side of the web in a second direction at an acute angle to the first direction.

If the second portion is located downstream of the predetermined portion of the path, the apertures of the second portion of the wall preferably direct the fluid medium against the one side of the running web at an angle of 63 to 70 degrees. If the second portion is located upstream of the predetermined portion of the path, the apertures of the second portion of the wall preferably direct the fluid medium against the one side of the running web at an angle of 69 to 75 degrees.

The apertured wall can include a third portion which is adjacent a third portion of the path and has apertures which direct against the one side of the web at least one third stream of fluid medium in such orientation that the third stream draws atmospheric air along the one side of the web and toward the predetermined portion of the path. The predetermined portion is disposed between the second and third portions of the path and each such portion extends across the entire path. The housing preferably includes or defines a first plenum chamber adjacent the first portion of the apertured wall, a second plenum chamber adjacent the second portion of the wall, and a third plenum chamber adjacent the third portion of the wall, and the apparatus further comprises means for supplying pressurized fluid medium to the plenum chambers. The supplying means can comprise a first compartment which is provided in the housing between the first and second plenum chambers, a second compartment which is provided in the housing between the first and third chambers, and means for feeding fluid medium into one of the compartments. The housing is provided with a first partition between the first compartment and the second chamber and with a second partition between the second compartment and the third chamber. Each partition has a plurality of openings and the housing can be further provided with a plurality of additional partitions which subdivide the first plenum chamber into a plurality of smaller chambers. The supplying means of such apparatus can further comprise valved conduit means connecting the smaller chambers with at least one of the compartments. The openings in one of the first and second partitions are preferably smaller than the openings in the other of the first and second partitions if the number of openings in the one partition is the same as the number of openings in the other partition. The purpose of such dimensioning of the openings is that the combined cross-sectional area of openings in the one partition should exceed the combined cross-sectional area of openings in the other partition. Tubular means (such as a pipe) can be provided to connect the first and second compartments to each other, and such tubular means preferably contains adjustable valve means for regulating the flow of fluid medium between the two compartments.

The second and third plenum chambers are respectively located upstream and downstream of the first plenum chamber, as seen in the direction of advancement of the web, and the feeding means is preferably connected with the first compartment (i.e., with the compartment between the upstream plenum chamber and the first plenum chamber). The valved conduit means preferably connect the smaller chambers of the first plenum chamber with the first compartment. The plenum chambers and the compartments are elongated and extend transversely of the direction of advancement of the web. The arrangement is preferably such that the feeding means is connected with one end of the first compartment, and the aforementioned tubular means connects the other end of the first compartment with the corresponding end of the second compartment.

The housing preferably further includes an end wall which is adjacent the second portion of the apertured wall. Both walls are spaced apart from the one side of the web in the predetermined path, and the end wall is preferably nearer to such path than the apertured wall. A second end wall is preferably provided adjacent the third portion of the apertured wall and is preferably nearer the predetermined path than the apertured wall. One of the two end walls is nearer to the predetermined path than the other end wall.

It is preferred to heat at least one of the end walls, and the such heating means can include the fluid medium which is caused to condense in the interior of the preferably tubular heated end wall. Each end wall can constitute a tube which has a polygonal (especially square or rectangular) cross-sectional outline.

If the path for the running web is flat or nearly flat, the portions of the apertured wall are substantially flat and the second and third portions make with the first portion oblique angles which need not appreciably deviate from 180 degrees. The apertures in such portions of the apertured wall can extend substantially at right angles to the planes of the respective portions of the apertured wall.

The apparatus can further comprise means for regulating the temperature of fluid medium which forms at least one of the streams ad/or means for regulating the velocity of at least one of the streams.

That wall of the housing of the improved apparatus which is adjacent the path of movement of the web has a predetermined thickness, and the apertures in the portions of this wall are preferably dimensioned in such a way that the diameters of at least some of the apertures at most equal or are less than the length of the apertures (i.e., less than the thickness of the corresponding portions of the wall). This ensures that the apertures can orient jets of steam or the like in preselected directions and the jets do not diverge prematurely, i.e., that they can penetrate through layers of condensate on the adjacent side of the running web.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
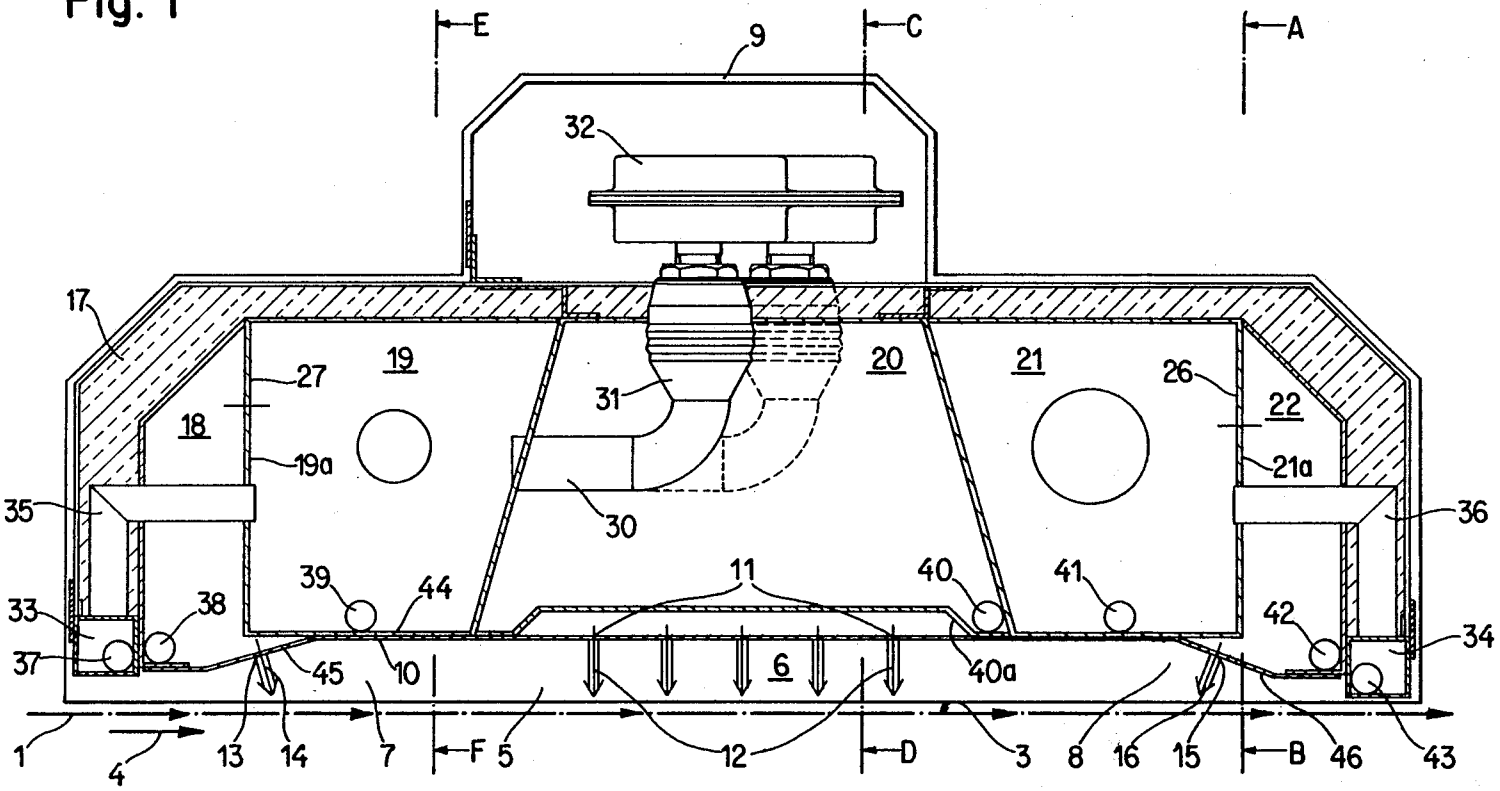
FIG. 1 is a longitudinal vertical sectional view of an apparatus which embodies one form of the invention, substantially as seen in the direction of arrows from the line G—H in FIG. 3.

Referring to FIGS. 1 to 5, there is shown an apparatus which serves to treat a running web 1 of moist fibrous material. The web 1 is advanced by a conveyor 101 in the direction which is indicated by arrows 4 so that its upper side 3 is exposed. The elongated path which is defined by the conveyor 101 is flat or substantially flat, and the apparatus comprises a housing 9 which extends transversely across the entire path for the web 1 (see FIG. 5) and includes an apertured bottom wall 10 having a relatively long median or first portion 44 which is spaced apart from the upper side 3 of the running web 1 and is provided with apertures 11 serving to discharge a plurality of jets 12 of a fluid medium (preferably steam) toward the upper side 3 of the web in the corresponding (predetermined) portion of the path. The jets 12 together form a first stream which flows substantially at right angles to the plane of the adjacent portion of the web 1 on the conveyor 101. The latter can constitute the upper reach of an endless foraminous conveyor which travels above the permeable top wall of a suction chamber in a paper making machine. The housing 9 and the conveyor 101 define an elongated treating zone 5 which includes a first or main section 6 where the jets 12 impinge upon the running web 1, a second or upstream section 7 which is located ahead of the first section 6 (as seen in the direction of arrows 4) and a third or downstream section 8. The end portions of the housing 9 can rest on the aforementioned suction chamber along both marginal portions of the running web 1.

The bottom wall 10 of the apparatus further includes a flat second portion 45 which makes with the median portion 44 an oblique angle of close to 180 degrees and is adjacent the section 7 of the treating zone 5. The portion 45 has apertures 13 (e.g., a single row which extends transversely of the direction of travel of the web 1) which discharge jets 14 of fluid medium at right angles to the plane of the wall portion 45 and at a relatively large acute angle to the plane of the web portion in the respective portion of the path. The jets 14 preferably flow at an angle of 69–75 degrees (most preferably at an angle of approximately 73 degrees) to the plane of the path for the web 1. This ensures that the jets 14 (which together form a second stream of gaseous fluid) draw some atmospheric air in the direction of arrows 4, i.e., some air is free to penetrate into the section 7 of the treating zone 5. At the same time, the jets 14 prevent fluid medium which enters the median section 6 of the treating zone 5 via apertures 11 from flowing counter to the direction which is indicated by the arrows 4 and across that portion of the path for the web 1 where the jets 14 impinge upon the upper side of the running web.

A third portion 46 of the bottom wall 10 has at least one row of apertures 15 which discharge jets 16 of fluid medium into the section 8 of the treating zone 5 downstream of the median section 6. The inclination of the jets 16 to the plane of the adjacent portion of the web 1 is preferably between 63 and 70 degrees, most preferably approximately 66 degrees. The flow of jets 16 is in part counter to the direction of advancement of the web 1 so that these jets prevent the fluid medium from escaping from the sections 6 and 8 by flowing along the upper side of the web 1 in the direction of arrows 4 and across the path of the jets 16. In fact, the jets 16 are likely to entrain some atmospheric air into the treating zone 5 at the downstream edge of the housing 9; they should ensure that little or no fluid medium which was admitted via apertures 11, 13 and 15 will escape into the surrounding atmosphere.

The apertures 13 and/or 15 can form two or more rows, and the number of rows of apertures 11 in the median portion 44 of the apertured bottom wall 10 can exceed or can be less than the number (five) shown in FIG. 1. The blocking or sealing action of jets 16 is or can be even more pronounced than that of the jets 14. Such sealing action is attributable to the well known venturi effect.

An advantage of the apertures 13 and 15 which discharge jets 14 and 16 is that it is possible to determine in advance the exact quantity of fluid medium which is to contact the web 1 in the treating zone 5 as well as that the area around the housing 9 is not filled (or is not rapidly filled) with such fluid medium. This contributes to greater predictability of treatment and to a reduction of the cost of heating the fluid medium (normally steam). The fluid medium condenses on and thus transfers heat to the web 1 in the treating zone 5.

Figure 5:
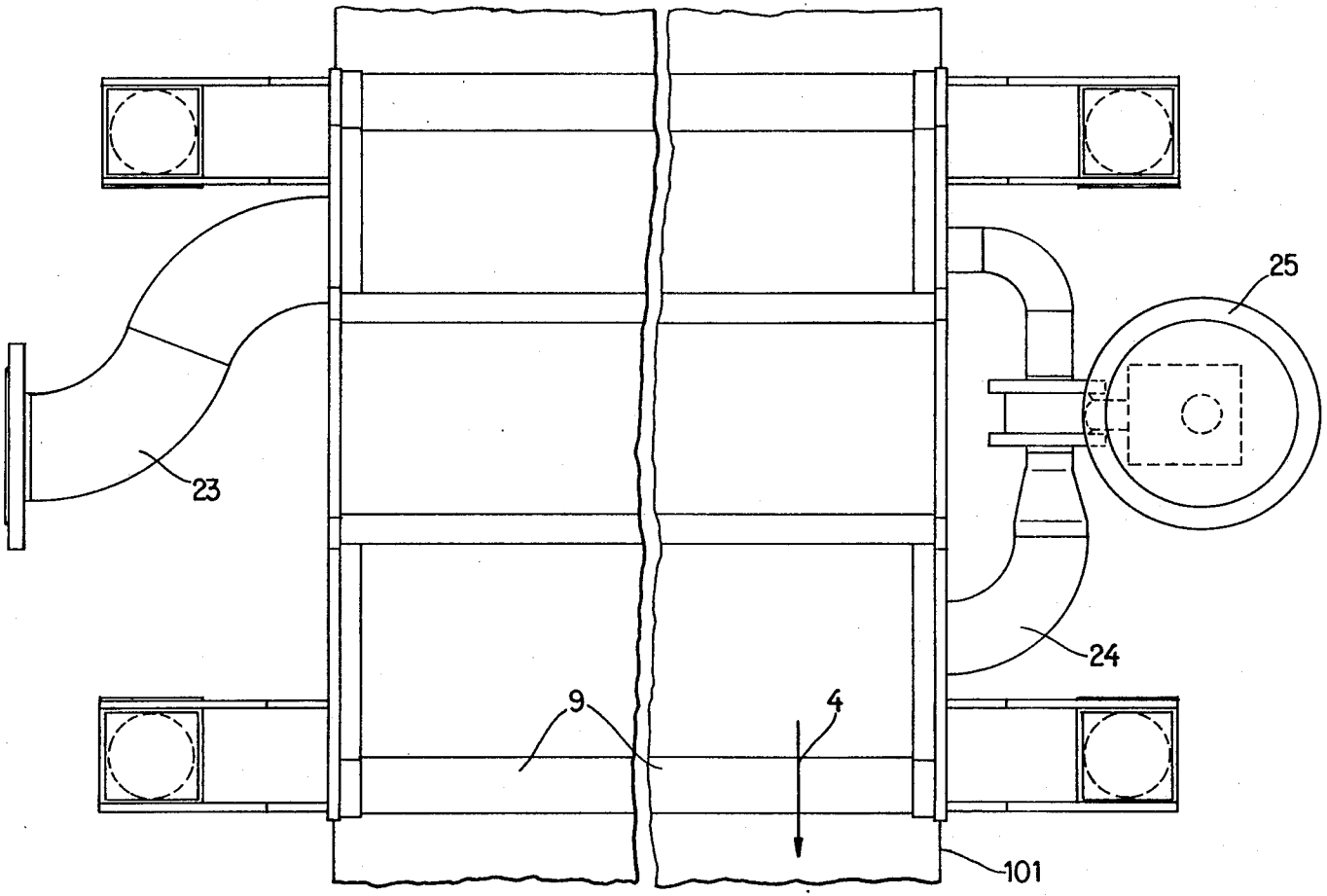
FIG. 5 is a fragmentary plan view of the apparatus.

The steambox which includes the housing 9 and the bottom wall 10 further comprises a jacket 17 of heat insulating material and has three elongated parallel plenum chambers including a main or first plenum chamber 20 above the bottom wall portion 44, a second plenum chamber 18 above the bottom wall portion 45, and a third plenum chamber 22 above the bottom wall portion 46. The plenum chambers 18, 20 are separated from each other by a first compartment 19 which forms part of the means for supplying fluid medium into the chambers 18, 20, 22, and such supplying means further includes a second compartment 21 which extends between the plenum chambers 20 and 22. The plenum chambers 18, 20, 22 respectively supply fluid medium to the apertures 13, 11 and 15. The means for feeding fluid medium into the compartment 19 or 21 comprises a steam supply pipe 23 containing an adjustable valve, not shown, and being connected to one end of the compartment 19 or 21. The other end of the compartment 19 or 21 is connected with the inlet of a tubular connector 24 which also contains an adjustable valve (such as a flow restrictor 25 shown in FIG. 5) and discharges fluid medium into the corresponding end of the compartment 21 or 19. FIG. 5 shows that the discharge end of the supply conduit 23 is connected to one side of the housing 9 and that the end portions of the tubular connector 24 are connected to the other side of the housing 9, i.e., the conveyor 101 is disposed between the conduit 23 and the connector 24. The purpose of the flow restrictor 25 is to enable the operators or automatic control means to regulate the pressure of fluid medium in such a way that the pressure in the compartment 19 deviates from the pressure in the compartment 21.

Figures 2, 3, 4:
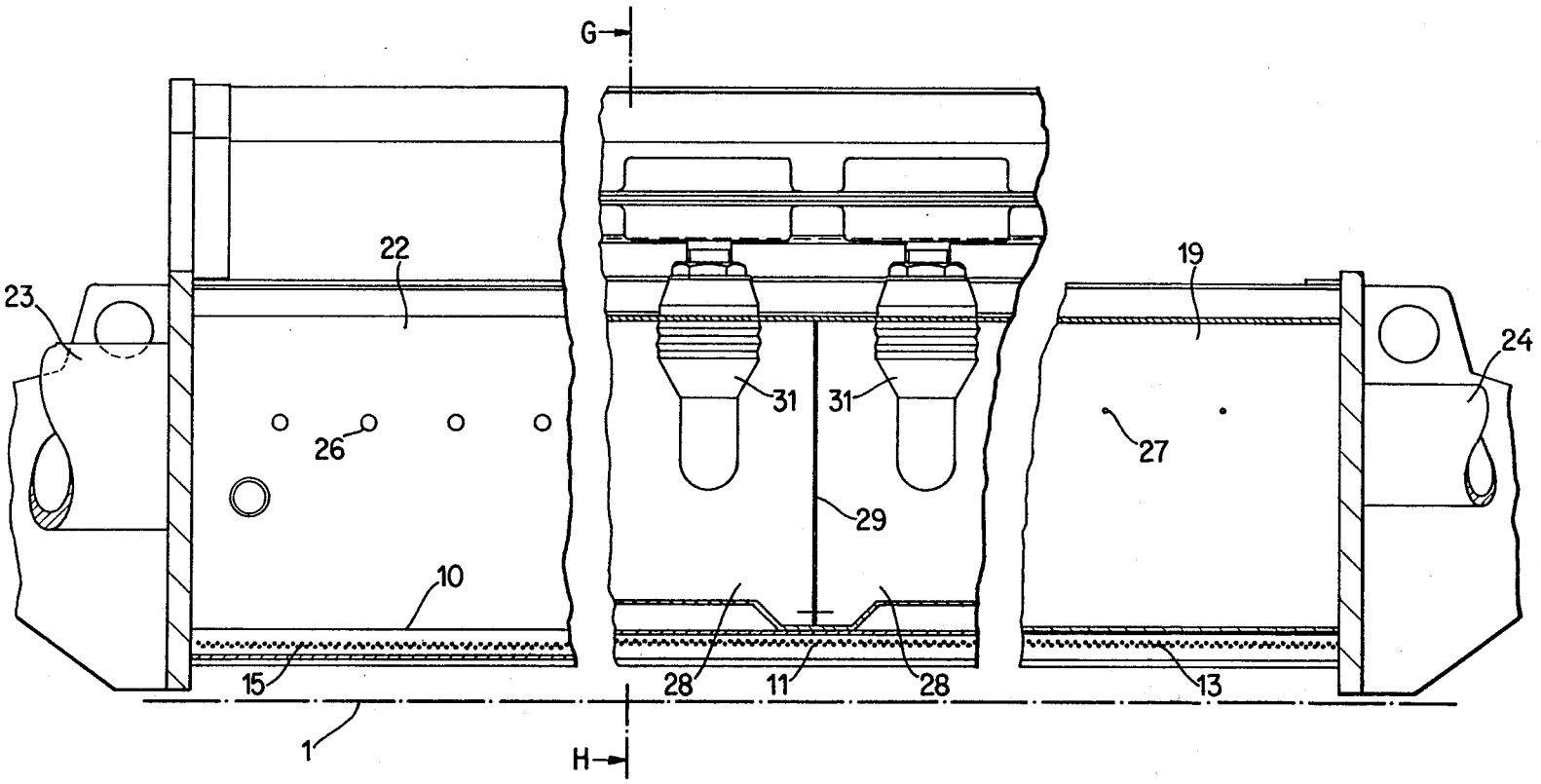
FIG. 2 is a fragmentary transverse vertical sectional view as seen in the direction of arrows from the line A—B in FIG. 1.
FIG. 3 is a fragmentary transverse vertical sectional view as seen in the direction of arrows from the line C—D in FIG. 1.
FIG. 4 is a fragmentary transverse vertical sectional view as seen in the direction of arrows from the line E—F of FIG. 1.

The housing 9 has a partition 21*a* which is disposed between the compartment 21 and the plenum chamber 22 and has one or more rows or other arrays of openings 26 which enable the fluid medium to flow from the compartment 21 into the plenum chamber 22 and thence into the apertures 15. As shown in FIG. 2, the openings 26 are relatively large and form a row which extends across the path for the web 1. A partition 19a between the compartment 19 and the plenum chamber 18 has a row of openings 27 which are smaller than the openings 26 (see FIG. 4) and establish paths for the flow of fluid medium from the compartment 19 into the plenum chamber 18 and thence into the apertures 13. The combined cross-sectional area of the openings 27 is less than the combined cross-sectional area of the openings 26.

The housing 9 further comprises a plurality of additional partitions 29 (see FIG. 3) which are disposed in parallel vertical planes extending in the direction of travel of the web 1 and subdivide the plenum chamber 20 into a row of smaller plenum chambers 28 each of which receives fluid medium from the compartment 19 by way of a conduit 30 containing an adjustable valve 31. Each valve 31 has at least one annulus of orifices which make acute angles with the plane of the running web 1 and direct streamlets of fluid medium from the respective conduit 30 against the walls (including the respective partitions 29) flanking the corresponding chamber 28. The chambers 28 form a row which extends transversely of the direction of advancement of the web 1. The means 32 for adjusting the valves 31, either individually or jointly, is disposed in a domed portion of the housing 9 above the plenum chamber 20. The adjusting means 32 can comprise one or more pneumatic regulators of known design.

It will be seen that the conduit 23 supplies fluid medium to the compartment 19 or 21, that the compartment 21 supplies fluid medium to the chamber 22 via openings 26 and to the compartment 19 via tubular connector 24, and that the compartment 19 supplies fluid medium to the chamber 18 via openings 27 and to the chamber 20 (i.e., to the smaller chambers 28) via conduits 30 and valves 31. The velocity of the fluid medium can be regulated by the valve means in the conduit 23, and the quantity of fluid medium which issues from the apertures 11 can be regulated by the valves 31. The quantity of fluid medium which issues via apertures 13 can be regulated by the flow restrictor 25 as well as by proper selection of the number and diameters of the openings 27. The number and the diameters of the openings 26 determine the rate of flow of fluid medium into the chamber 22 and thence into the apertures 15. The apertures 11, 13 and 15 preferably constitute holes whose axes are normal to the planes of the respective portions (44–46) of the bottom wall 10.

The apparatus further comprises a first end wall 33 which is adjacent the chamber 18, and a second end wall 34 which is adjacent the chamber 22. The distance of the end walls 33, 34 from the path for the web 1 is less than the distance of the bottom wall 10 from such path, and the end wall 34 is nearer to the web 1 than the end wall 33. This enhances the sealing action of the jets 14 and 16, i.e., such mounting of the end walls 33, 34 reduces the likelihood of escape of appreciable quantities of fluid medium from the treating zone 5. Each of the end walls 33, 34 preferably comprises a pipe or tube having a non-circular (preferably square or rectangular) cross-sectional outline. Such tubing can be made at a low cost from sheet metal to reduce the overall weight and cost of the apparatus. One end portion of the end wall 33 is connected with a conduit 35 which receives fluid medium from the compartment 19, and one end of the end wall 34 receives fluid medium from the compartment 21 by way of a conduit 36. Heated fluid medium which enters the end walls 33 and 34 condenses therein and thereby heats the end walls with the result that any droplets of water which deposit at the outer sides of the end walls 33 and 34 evaporate instead of descending onto the running web 1. Droplets of water could adversely affect the strength as well as the appearance of the web 1, especially if the latter is to be converted into a relatively thin sheet of high-quality paper.

The apparatus contains a plurality of conduits including the conduits 37, 38, 39, 40, 41, 42 and 43 which serve to gather condensate and to evacuate the gathered condensate from the housing 9. The conduits 37, 43 respectively evacuate condensate from the hollow end walls 33, 34; the conduits 39 and 41 respectively evacuate condensate from the compartments 19, 21; the conduits 38, 42 respectively evacuate condensate from the plenum chambers 18, 22; and the conduit 40 evacuates condensate from the median plenum chamber 20. The inlet of the conduit 40 is located in a trough 40a which is provided in the plenum chamber 20, preferably all the way around the central portion 44 of the bottom wall 10. Similar or analogous troughs for the gathering of condensate can be provided in the hollow end walls 33, 34 in the chambers 18, 22 and/or in the compartments 19, 21. The trough 40a is optional; it can be omitted in apparatus for the treatment of certain types of webs.

Any condensate which gathers in the valves 31 as a result of a drop of pressure of fluid medium which is supplied by the respective conduits 30 is propelled by the jets of outflowing fluid medium against the surfaces of adjacent partitions 29 in the plenum chamber 20 and flows along such surfaces toward the bottom wall 10 to enter the trough 40a and to be evacuated by way of the conduit 40.

Means can be provided to regulate the temperature of fluid medium which enters the portion 6 of the treating zone 5. Such temperature regulating means can be installed in the compartment 19 and/or in the conduits 30 and/or in the chambers 28 and/or on the portion 44 of the wall 10.

An important advantage of the improved method and apparatus is that the fluid medium which is discharged via apertures 11, 13 and 15 (especially the bulk of fluid medium which is discharged via apertures 11) is utilized more efficiently and also that the area around the apparatus is not filled with fluid medium which is used to treat the running web. Each of the jets 14 and 16 has a component of movement toward the central section 6 of the treating zone 5, i.e., toward the mass of fluid medium which is discharged via apertures 11 in the central portion 44 of the bottom wall 10. Thus, and in contrast to heretofore known proposals to use the treating fluid medium as a barrier which is to prevent penetration of atmospheric air into the treating zone 5, the apparatus of the present invention is designed to use atmospheric air as a means for preventing, or for at least greatly reducing, the escape of fluid medium from the treating zone 5. This is achieved in that the jets 14 and 16 (or at least the jets 16) exhibit a tendency to draw air into the respective portions (7 and 8) of the treating zone 5.

The aforediscussed advantages of the improved method and apparatus bring about additional important advantages. Thus, and since at least the major percentage of fluid medium which is admitted into the treating zone 5 is confined therein, and since the inclination of the jets 14 and/or 16 can be readily selected in such a way that they can effectively oppose or prevent the escape of fluid medium from the treating zone 5, the adjusting means 32 can be set to effect the admission of larger quantities of fluid medium into the chambers 28, i.e., larger quantities of fluid medium are caused to contact the web in the path portions which are adjacent the sections 6, 7 and 8 of the treating zone 5. This applies especially for the section 6 of the treating zone. The result is that each increment of the running web 1 is contacted by a larger quantity of fluid medium (normally steam) to enhance the transfer of heat from the fluid medium to the web with attendant improvement of the efficiency of the apparatus. The moisture content of air in the space around the apparatus is reduced to a fraction of the moisture content of air in the space which accommodates a conventional apparatus; this is due to the fact that the jets 14 and 16 reduce or prevent the escape of fluid medium along the adjacent side of the web and into the surrounding area.

The reason for more pronounced inclination of jets 16 with respect to the jets 12 is that the jets 16 must overcome the tendency of fluid medium to escape from the treating zone 5 due to the fact that the pressure in the treating zone is or can be higher than in the area around the housing 9 as well as because the jets 16 must oppose the natural tendency of the fluid medium to advance with the adjacent side of the web 1 in the direction which is indicated by arrows 4. Lesser inclination of jets 14 relative to the jets 12 is normally satisfactory or acceptable because the advancing web 1 tends to oppose the escape of fluid medium beneath the end wall 33 in a direction counter to that which is indicated by arrows 4.

The compartments 19 and 21 contribute to more uniform distribution of fluid medium across the width of the running web 1 and thus promote a predictable reduction of the moisture content of the running web. The speed of jets 14 and 16 is normally higher than that of the jets 12 in order to ensure that the jets 14 and 16 can properly oppose the escape of appreciable quantities of fluid medium from the central section 6 of the treating zone 5 and across the respective sections 7, 8 toward and beneath the respective end walls 33 and 34. The speed of the jets 16 is or can be higher than the speed of the jets 14; this is achieved by the aforediscussed selection of the combined cross-sectional areas of the openings 26 and 27. As mentioned above, the adjustable flow restrictor 25 in the tubular connector 24 allows for a selection of pressures in the compartments 19 and 21 such that the jets 14 can effectively block the flow of fluid medium toward and beneath the end wall 33 and the jets 16 can effectively block the flow of fluid medium toward and beneath the end wall 34.

The feature that the main plenum chamber 20 receives fluid medium from the compartment 19 ensures that the path for the flow of fluid medium from the main source (not shown) to the chambers 28 is relatively short, especially if the outlet of the supply conduit 23 is connected to one end of the compartment 19.

The end walls 33 and 34 act not unlike flow restrictors which contribute to the sealing action of the jets 14 and 16. Since the sealing action should be more pronounced at the downstream end of the housing 9, the end wall 34 is normally placed nearer to the path for the web 1 than the end wall 33. Moreover, it is desirable to maintain the end wall 33 at the inlet or upstream end of the housing 9 at a reasonable distance from the path for the web 1 in order to reduce the likelihood of rapid clogging of the space beneath the end wall 33 by protruding particles of fibrous material. Still further, such positioning of the end wall 33 at a reasonable distance from the path for the web 1 is particularly desirable and advantageous when the conveyor 101 advances the web at a level above a suction chamber. If the end wall 33 were to prevent entry of sufficient quantities of atmospheric air, the suction chamber beneath the conveyor 101 would attract the web 1 with a force which could result in damage to or complete destruction of the web.

Heating of the end walls 33 and 34 is desirable and advantageous because these end walls are in continuous contact with relatively cool atmospheric air with a tendency of moisture in such air to condense on the external surfaces of the end walls and to drip onto the running web. The condensate not only affects the appearance and the quality of the web but also the predictability of treating action of fluid medium in the treating zone 5 upon the adjacent portion of the web. The feature that the end walls 33 and 34 are heated by fluid medium which is admitted via conduits 35 and 36 contributes to the economy of operation, i.e., there is no need for the provision of discrete heating means which would consume additional energy and would take up additional space.

The apparatus which is shown in FIGS. 1 to 5 has been found to be especially suitable for the treatment of webs which advance along a flat or straight path. Thus, it is possible to achieve a desired orientation of jets 12, 14 and 16 by the simple expedient of drilling in the flat wall portions 44, 45 and 46 holes whose axes are normal to the planes of the respective wall portions and to select the inclination of the wall portions 44, 45 and 44, 46 relative to each other with a view to ensure that the jets 14 and 16 will be properly inclined with reference to the plane of the running web and with reference to the jets 12. The inclination of wall portion 45 and/or 46 relative to the wall portion 44 is preferably adjustable (the adjusting means are not shown), e.g., by mounting the wall portions 45, 46 on hinges and by providing membranes between the wall portions 45, 46 and the end walls 33, 34, respectively.

If the apparatus of FIGS. 1 to 5 is turned upside down so that its wall 10 is adjacent the underside of a running web, the condensate evacuating conduits corresponding to the conduits 37 to 39 and 41–43 are transferred into the deepmost portion of the housing and the conduit 40 (with the trough **40*a***) is or can be omitted.

Figure 6:
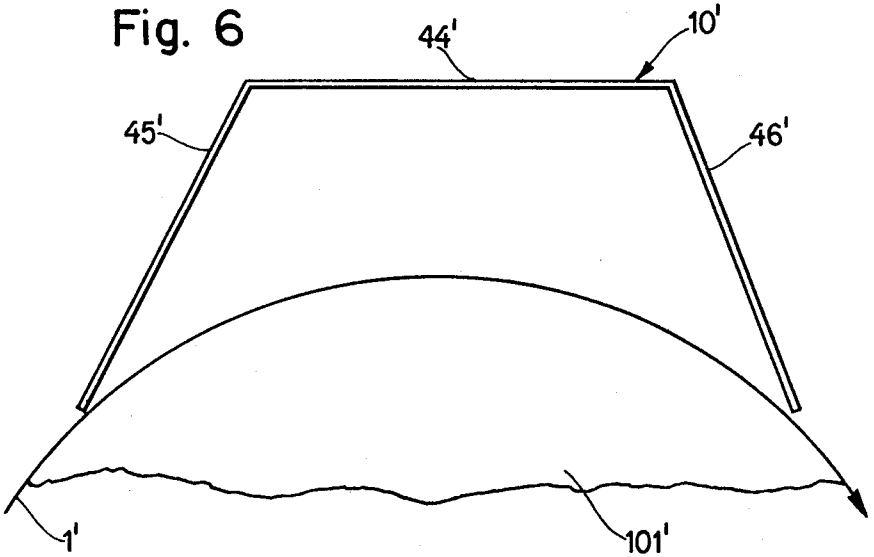
FIG. 6 is a schematic sectional view of the apertured wall of a second apparatus.

If the apertured wall 10' (FIG. 6) of the improved apparatus is adjacent the convex side of a running web 1' (e.g., if the web is trained over the periphery of a driven roller or cylinder 101'), the portions 44, 45 and 46 of the flat bottom wall 10 are replaced with appropriately inclined or curved bottom wall portions 44', 45', 46' but the mutual inclination of the wall portions 44', 45', 46' remains substantially the same as that of the flat wall portions 44, 45, 46, i.e., the apertures of the wall portions 45' and 46' orient the respective jets of fluid medium in such a way that they prevent the escape of fluid medium which has entered the central section of the treating zone by way of apertures in the wall portion 44'.

Figure 7:
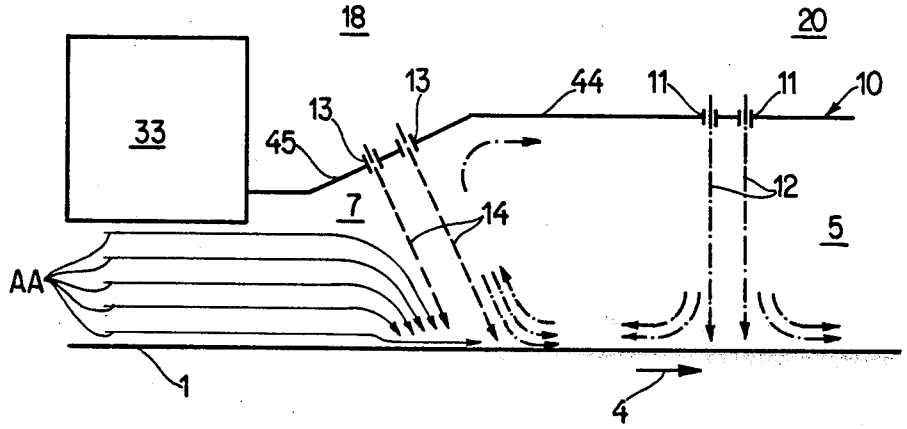
FIG. 7 is a fragmentary diagrammatic sectional view of the apparatus of FIGS. 1-5, showing the manner in which atmospheric air prevents steam from escaping at the upstream end of the apparatus when the distance of the upstream end of the apparatus from the web and the velocities of the jets of steam are satisfactory.

FIG. 7 shows an acceptable positioning of the tubular end wall 33 of the housing of the improved apparatus with reference to the path of the running web 1 which advances in the direction of arrow 4. The jets 12 of steam which is discharged by way of orifices 11 in the median portion 44 of the bottom wall 10 of the housing are indicated by phantom lines, and the jets 14 of steam which are discharged by the orifices 13 of the bottom wall portion 45 are denoted by broken lines. The flow of atmospheric air is indicated by the arrows AA. The distance of the tubular end wall 33 from the upper side of the web 1 and the velocity of jets 12, 14 are selected in such a way that atmospheric air flows into the treating zone 5 but steam cannot escape beneath the end wall 33 by flowing counter to the direction which is indicated by the arrow 4. The manner of regulating and/or selecting the velocity of steam in the chambers 18 and 20 which respectively communicate with the apertures 13, 11 was described above.

Figure 8:
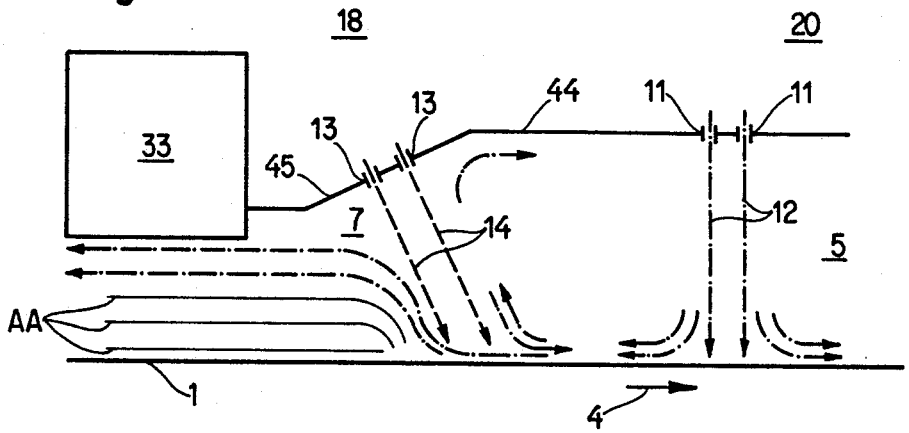
FIG. 8 shows the structure of FIG. 7 and the manner in which steam escapes from the treating zone when the velocity of jets of steam at the upstream end of the apparatus is too low.

FIG. 8 shows the structure of FIG. 7. The velocity of steam which is discharged via orifices 13 of the bottom wall portion 45 is too low so that steam which is admitted via orifices 11 can flow between the upper side of the running web 1 and the jets 14 to escape along the underside of the end wall 33 in spite of the fact that the jets 14 draw or tend to draw atmospheric air (arrows AA) into the adjacent section 7 of the treating zone 5. The distance of the end wall 33 from the upper side of the web 1 is the same or nearly the same as in FIG. 7.

Figure 9:
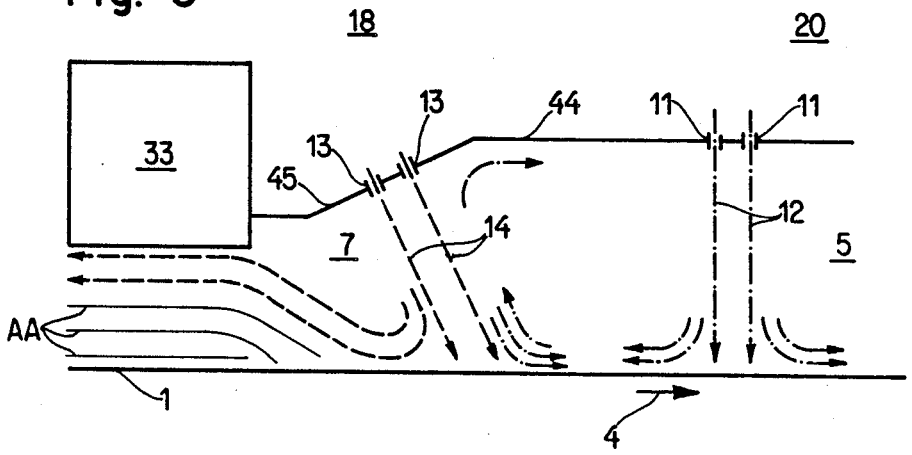
FIG. 9 shows the structure of FIGS. 7-8 and the manner in which steam escapes from the treating zone when the velocity of jets of steam entering the main section of the treating zone is too high.

FIG. 9 shows the structure of FIGS. 7 and 8. The pressure in the chamber 18 is too high so that the velocity of jets 14 which are discharged via orifices 13 is too high. Therefore, steam which is admitted into the section 7 of the treating zone 5 escapes between the underside of the end wall 33 and the flow of atmospheric air AA which is drawn into the section 7 due to the inclination of jets 14 with reference to the jets 12.

It will be seen that proper sealing of the treating zone 5 from the surrounding atmosphere (as far as the escape of steam is concerned) involves an appropriate selection of the distance of the end wall 33 from the path for the running web 1, an appropriate selection of the inclination of the jets 14 with reference to the jets 12, an appropriate selection of the velocity of jets 14 in the section 7 of the treating zone 5, and an appropriate selection of the speed of jets 12 which enter the first or main section 6 of the treating zone 5 between the bottom wall portion 44 and the running web 1.

Figure 10:
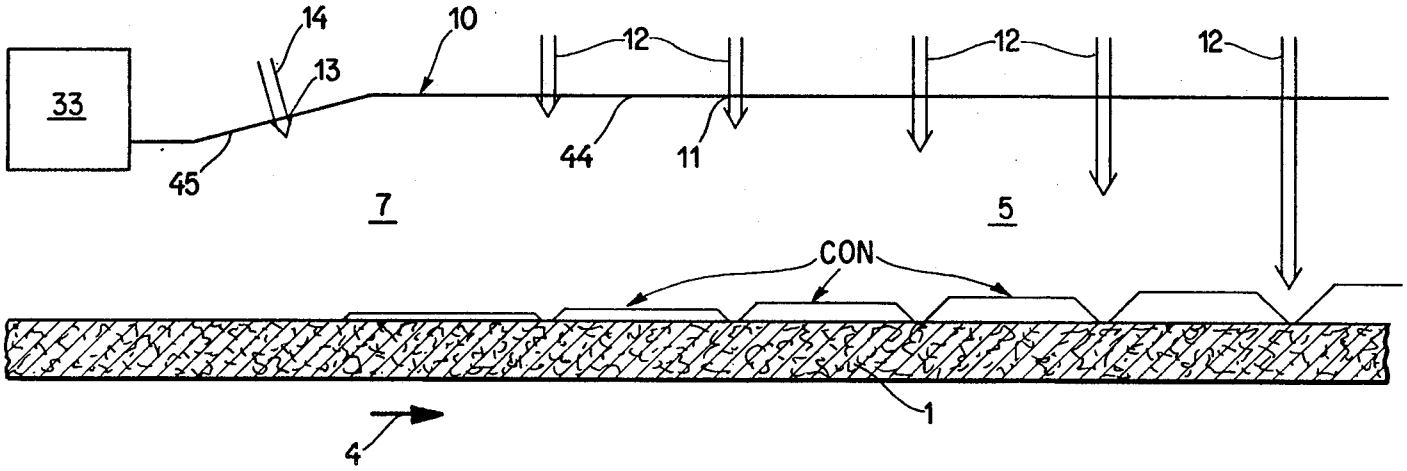
FIG. 10 is a fragmentary schematic sectional view of the apparatus, showing one presently preferred distribution of the velocities of jets which are directed toward the running web.
Figure 11:
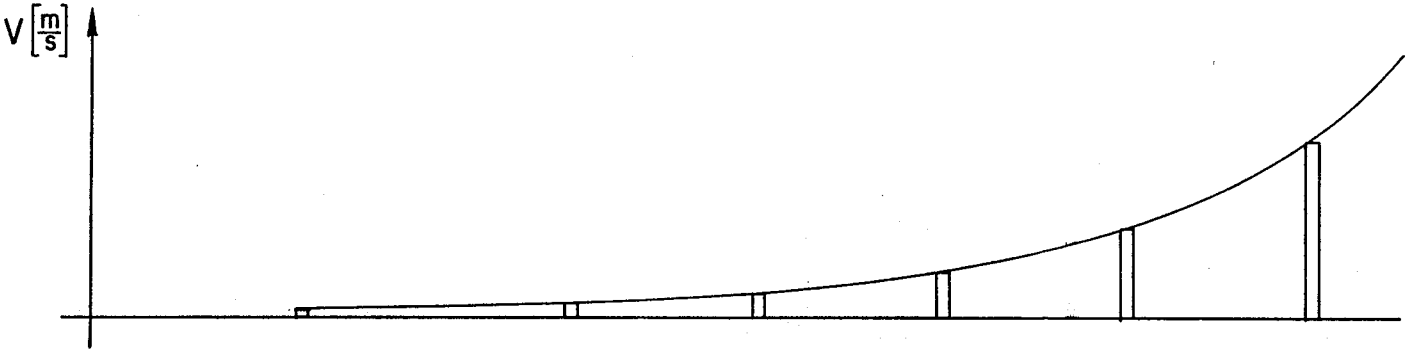
FIG. 11 is a diagram wherein the velocity of steam is measured along the ordinate and the distance of successive increments of the running web from the upstream end of the apparatus is measured along the abscissa.

FIGS. 10 and 11 show a presently preferred mode of selecting the velocity of jets 12, 14 and 16 (not shown) in different sections 7, 6, 8 of the treating zone 5. The arrow representing the jet 14 is short to denote that the velocity of steam which flows through the apertures 13 is relatively low. The velocity of steam which forms the jets 12 and flows via apertures 11 increases in a direction from the section 7 toward the section 8 (not shown) of the treating zone 5, and the velocity of steam which forms the jet or jets 16 (not shown in FIG. 10) can be even higher. FIG. 10 further shows a web 1 of fibrous material and condensate CON which accumulates on top of the web 1. The arrow 4 again indicates the direction of advancement of the web 1 along the treating zone 5. The thickness of condensate CON increases as a result of contact of successive increments of the running web 1 with additional steam. The velocity of jets 12 increases in the same direction to ensure that steam will penetrate into the mass of fibrous material beneath the layer of condensate.

In the diagram of FIG. 11, the velocity V of steam (in meters per second) is measured along the ordinate and the thickness of the layer of condensate CON on the running web 1 is measured along the abscissa. Thus, the velocity of steam increases with increasing distance of an increment of the web 1 from the tubular end wall 33 of the housing which includes the bottom wall 10. An advantage of such selection of velocity is that impingement of low-speed jets 12 of steam upon the web 1 close to the end wall 33 (where there is no condensate or the layer of condensate on the web 1 is relatively thin) does not entail any damage to the material of the web. On the other hand, increasing velocity of jets 12 in a direction from the end wall 33 toward the other tubular end wall 34 (not shown in FIG. 10) of the housing 9 ensures that such jets can penetrate through the layer of condensate CON even though the thickness of such layer increases more or less gradually in the direction of arrow 4. This ensures that freshly admitted steam can reach and can condense on the upper side of the running web 1.

Figure 13:
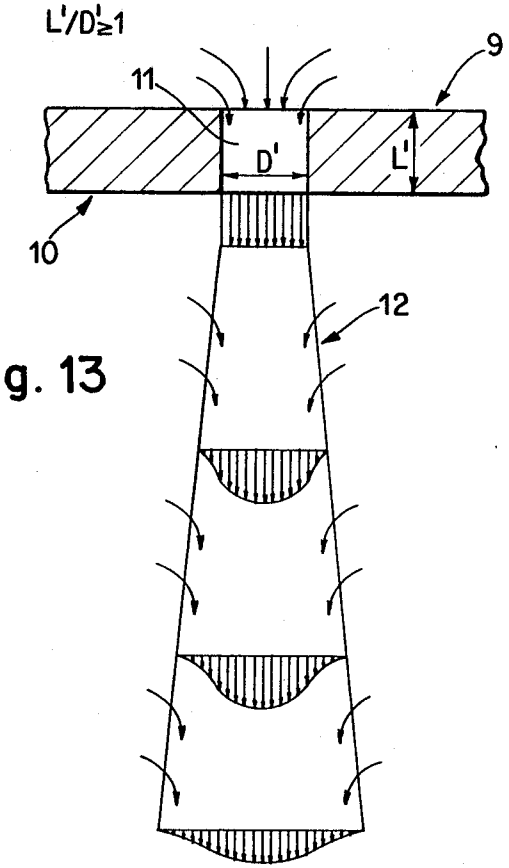
FIG. 13 is a fragmentary sectional view of a portion of an apertured wall in the apparatus of the present invention wherein the diameter of the aperture equals or is less than the thickness of the respective portion of the wall.
Figure 12:
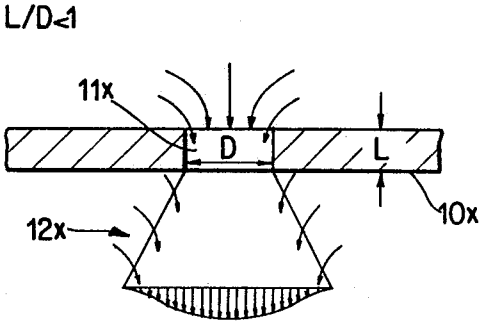
FIG. 12 is a fragmentary sectional view of a portion of an apertured wall in a conventional apparatus wherein the diameter of the aperture for a jet of steam is greater than the thickness of the wall.

FIG. 12 shows a conventional mode of forming the bottom wall of a housing with apertures for jets or streams of steam. The thickness L of the bottom wall 10x is a relatively small fraction of the diameter D of the illustrated conventional aperture 11x, FIG. 13 shows a novel mode of making apertures in the wall 10 of the housing 9 which forms part of the improved apparatus. The thickness L' of the wall 10 at least equals or closely approximates but can actually exceed the diameter D' of the aperture 11. Therefore, the rate of divergence of the jet 12 which issues from the aperture 11 shown in FIG. 13 is much less pronounced than the rate of divergence of the jet 12x which is shown in FIG. 12. This enables the jets 12 to penetrate through condensate CON (FIG. 10) even though the thickness of the layer of condensate increases in a direction from the end wall 33 toward the end wall 34 of the housing 9.

The presently preferred distance of the wall 10 or 10' from the path of the running web 1 or 1' is 30–40 mm but such distance can be reduced in the region of the tubular end wall 33 or 34.

The weight of the apparatus will depend on its length (as measured transversely of the direction of advancement of the web) and will normally vary between 650 and 1300 kg. The length of the apparatus is normally between 3.5 and 11 meters, depending on the width of the web.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of treating a running moist fibrous web with steam, comprising the steps of transporting the web along a predetermined path; directing at least one first stream of steam against one side of the running web in a predetermined portion of said path; directing at least one additional stream of steam against the one side of the running web in a second portion of said path adjacent said predetermined portion, said step of directing said first stream including conveying said first stream through at least one aperture having a length which at least equals the width thereof; orienting the additional stream with reference to the web in said path in such a way that the additional stream draws atmospheric air toward the predetermined portion of the path; and regulating at least one of the first and additional streams so that the drawn atmospheric air substantially prevents the flow of steam along the one side of the running web and out of the second portion of said path in a direction counter to the direction of flow of atmospheric air drawn by the additional stream; and wherein the step of directing the first stream includes directing a plurality of first jets of steam in a first direction substantially at right angles to the one side of the running web, said step of directing the additional stream including directing a plurality of second jets of steam against the one side of the running web in the second portion of said path, said orientating step including confining said jets of said additional stream to a flow at an acute angle to said first direction.

2. The method of claim 1, wherein said regulating step comprises regulating the velocity of at least one of the first and additional streams.

3. The method of claim 1, wherein said regulating step comprises regulating the quantity of fluid medium which forms at least one of said streams.

4. The method of claim 3, wherein said regulating step includes regulating the velocity of the respective stream.

5. The method of claim 1, further comprising the step of regulating the temperature of the steam which forms at least one of said streams.

6. The method of claim 1, wherein said step of directing the first stream includes establishing and maintaining a supply of steam adjacent the predetermined portion of the path and discharging said plurality of jets of steam from the supply against the one side of the running web in the predetermined portion of said path.

7. The method of claim 6, further comprising the step of continuously admitting fresh steam to said supply, including directing into the supply a plurality of streamlets of steam at an acute angle to the plane of the running web in the predetermined portion of the path so that the streamlets form at least one annulus of streamlets.

8. The method of claim 1, wherein the second portion of the path is located upstream of the predetermined portion as seen in the direction of advancement of the web.

9. The method of claim 1, wherein the second portion of the path is located downstream of the predetermined portion as seen in the direction of advancement of the web.

10. The method of claim 1, wherein the one side is the upper side of the web.

11. The method of claim 1, wherein the one side is the underside of the web.

12. The method of claim 1, wherein said path is an arcuate path having a convex side and a concave side and the one side of the web is located at the convex side of said path.

13. The method of claim 1, further comprising the steps of directing at least one third stream of steam against the one side of the running web in a third portion of said path adjacent said predetermined portion, and regulating at least one of the first and third streams so that the drawn atmospheric air inhibits the flow of fluid medium along the one side of the running web and out of the third portion of said path in a direction counter to the direction of flow of atmospheric air drawn by the third stream, said predetermined portion of said path being located between said second and third portions.

14. The method of claim 13, wherein said second portion of said path is located upstream of said predetermined portion and said third portion is located downstream of said predetermined portion as considered in the direction of advancement of the web.

15. The method of claim 8, wherein said orienting step is performed in such a manner that the additional stream is inclined to the one side of the running web at an angle of approximately 69 to approximately 75 degrees.

16. The method of claim 15, wherein said orienting step is performed in such a manner that said angle is approximately 73 degrees.

17. The method of claim 9, wherein said orienting step is performed in such a manner that the additional stream is inclined to the one side of the running web at an angle of approximately 63 to approximately 70 degrees.

18. The method of claim 17, wherein said orienting step is performed in such a manner that said angle is approximately 66 degrees.

* * * * *